US005775554A

United States Patent [19]

Taylor

[11] Patent Number: 5,775,554

[45] Date of Patent: Jul. 7, 1998

[54] SPRING LOADED CAPTURE HANGER

[76] Inventor: Arthur F. Taylor, 528 Broward Rd., Jacksonville, Fla. 32218

[21] Appl. No.: 789,636

[22] Filed: Jan. 27, 1997

Related U.S. Application Data

[63] Continuation-in-part of Ser. No. 395,856, Feb. 28, 1995, abandoned.

[51] Int. Cl.[6] ..... A47G 25/49; A47G 25/18

[52] U.S. Cl. ..... 223/96; 223/91

[58] Field of Search ..... 223/85, 88, 90, 223/91, 93, 95, 96

[56] References Cited

U.S. PATENT DOCUMENTS

| | | | |
|---|---|---|---|
| 2,805,805 | 9/1957 | Orzech et al. | 223/91 |
| 2,963,207 | 12/1960 | Glowka | 223/91 |
| 3,229,871 | 1/1966 | Cape | 223/96 |
| 3,411,680 | 11/1968 | Lundeen | 223/96 |
| 4,768,686 | 9/1988 | Storti | 223/92 |
| 5,040,707 | 8/1991 | Ayano et al. | 223/89 |
| 5,080,268 | 1/1992 | Rios | 223/96 |

*Primary Examiner*—Bibhu Mohanty
*Attorney, Agent, or Firm*—Arthur G. Yeager

[57] ABSTRACT

A clothes hanger includes a spring-loaded movable capture bar that holds clothes placed between it and a hanger bar. The capture bar is movably mounted between the hanger bar and an upper support bar to which is connected a hook for hanging the hanger of a rod or other device. The capture bar and hanger bar have cooperating curved surfaces or they may have planar surfaces one of which is covered by felt. A finger pull flange or finger hole is mounted to the top of the capture bar for one-handed upward movement of the capture bar by a user.

20 Claims, 4 Drawing Sheets

SPRING LOADED CAPTURE HANGER

CROSS-REFERENCE TO RELATED APPLICATION

This is a continuation-in-part of application Ser. No. 08/395,856, filed Feb. 28, 1995 now abandoned.

BACKGROUND OF THE INVENTION

1. Field of the Invention

The present invention pertains to clothes hangers and particularly to hangers that employ grasping apparatus to secure items of clothing thereto.

2. Prior Art

There are a wide variety of clothes hangers known to the prior art. See for example U.S. Pat. No. 2,963,207. Hangers usually do not have a positive engaging means to secure clothing items such as ties or pants thereto. Those hangers that do have clamps and the like tend to be difficult to operate even with two hangs. Furthermore, the space between engaging surfaces is not adjustable. These prior art hangers are not satisfactory. What is desired is a simple and easy to use hanger that can accommodate clothing of a wide range of thicknesses.

SUMMARY OF THE INVENTION

In accord with the present invention there is provided a garment hanger comprising a supporting structure with two arms extending in opposite directions and a central hole therethrough, a hanger bar with vertical ends connected to the bottom of the arms of the supporting structure with a horizontal bar between the vertical ends, a U-shaped capture bar having ends with holes receiving the vertical ends therethrough, and a hook extending through the central hole, the hook being connected to a finger pull which is attached to the capture bar, wherein the capture bar is biased by spring means to grasp a garment placed above the hanger bar.

In other aspects of the invention there is provided a clothes hanger comprising an elongate support m ember having opposite end portions and an elongate hanger member having opposite end portions, a pair of spaced post members, each post member being mounted between one end portion of the support member and one end portion of the hanger member to space the support and hanger members apart. An elongate engaging member has opposite end portions, each end portion of the engaging member having a passageway therethrough, the engaging member being slidably mounted on the posts disposed in respective passageways between the support and hanger members. There are biasing means attached between the support member and the engaging member for forcing the engaging member into contact with the hanger member to grasp articles of clothing placed therebetween. The engaging member includes lifting means for moving the engaging member against the biasing means to provide space between the engaging and hanger members to permit ready removal of articles of clothing therefrom and attachment means mounted to one of the members for suspending the hanger vertically.

In other aspects of the invention the biasing means includes a coil spring around each post. The engaging member includes a curved lower surface and the hanger member including a curved upper surface, the surfaces cooperating to engage articles therebetween when the engaging member is forced into contact with the hanger member by the biasing means. The support member includes a shaft passageway therethrough, the attachment means including a shaft member mounted through the shaft passageway and to the engaging means, the biasing means including a coil spring around the shaft. The lower surface of the engaging member is substantially planar, the upper surface of the hanger member is substantially planar and felt material is attached to the surface. The upper surface of the hanger member and the lower surface of the engaging member are substantially planar, the upper surface being covered with felt material. The support member is substantially straight from one end portion to the other end portion and the attachment means has a lower portion attached to a member and an upper portion, the upper portion including a hook member. A pad of resilient material is mounted on one of the facing surfaces of the hanger and engaging members, preferably on the hanger member. The lifting means includes a horizontally disposed opening in the engaging member for receiving a finger of a user to lift the engaging member for removing and/or placing articles of clothing on the hanger member.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood reference to the following description taken in connection with the accompanying drawings, in which:

DETAILED DESCRIPTION OF THE PREFERRED EMBODIMENT INTRODUCTION

In general, the hanger comprises a supporting structure with two arms extending in opposite directions and a central hole therethrough, a hanger bar with vertical ends connected to the bottom of the arms of the supporting structure with a horizontal bar between the vertical ends. A capture bar has ends with holes to receive the vertical ends therethrough, and a hook with a shaft extending through the central hole. The hook is connected to a finger pull which is attached to the capture bar. The capture bar is biased by spring means to grasp a garment placed above the hanger bar. The space between the capture and hanger bar can accommodate items as thick as 1 inch as determined by the capture bar vertical travel limit.

The present invention is a spring-loaded capture hanger which provides a captive feature to hold the clothing item secure whether placed in a clothes closet or travel bag.

Figure 1:
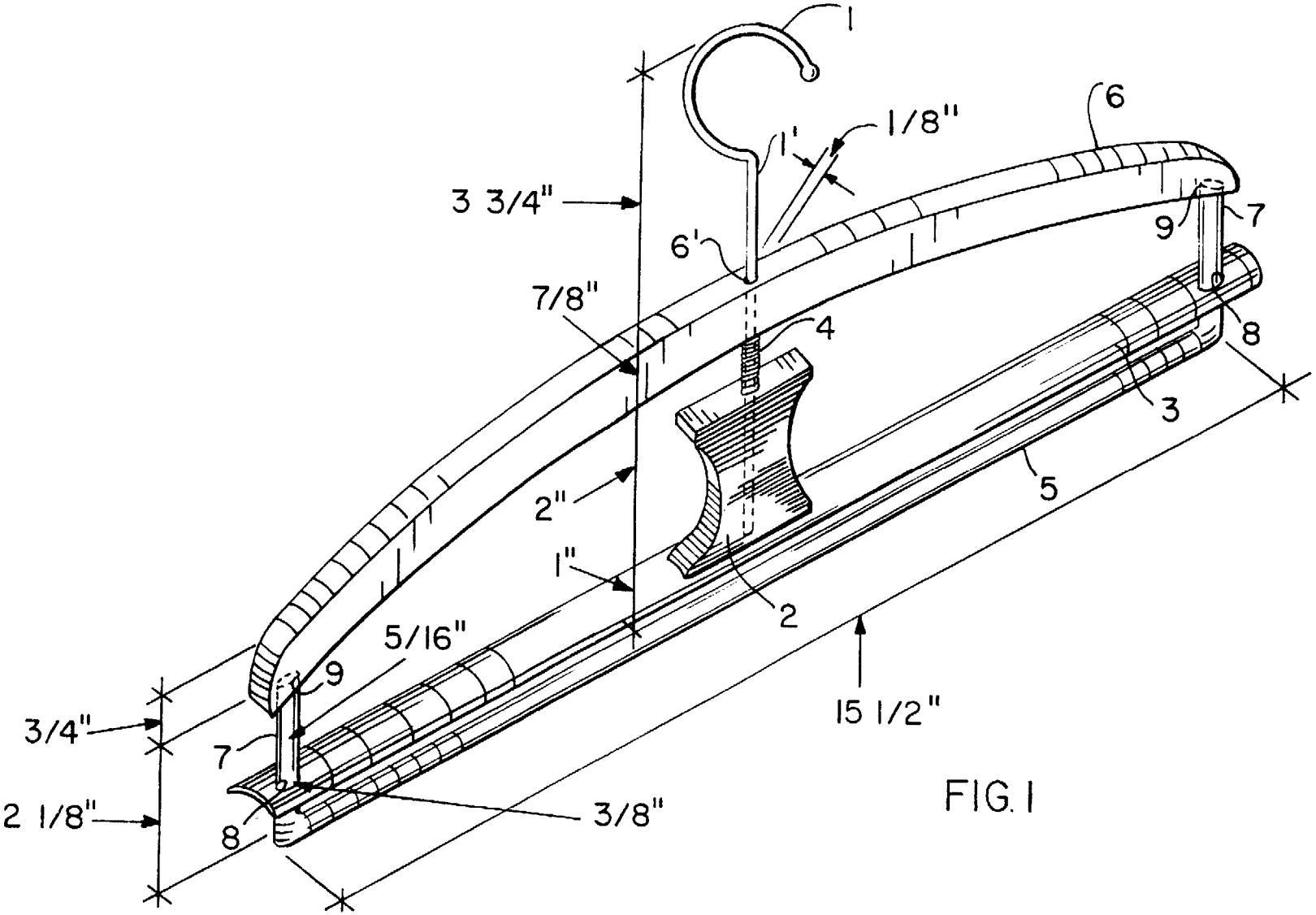
FIG. 1 is a pictorial view of one embodiment of the present invention illustrating nominal sizes and distances associated with the device.

As illustrated in FIG. 1, the basic elements of the hanger are as follows:

1. "1" is the hook part of the invention. "1" is a 3/32" inches round cadmium plated steel rod with a formed 2"

outside diameter hook with rounded end with one quarter of its diameter open to allow for placement over a hanger rod.

The shaft part of the hook is tooled to have a ⅞ inch screw at a distance which occurs 3 and ¾ down from the top which screws through the supporting structure.

The bottom two inches of the shaft is smooth which allows vertical travel of the finger pull against the spring thus raising the capture bar.

2. "2" and "3" are the one-piece molded plastic finger pull and half-round capture bar. There is a ⅛" round vertical hole in the center of the finger pull which allows it to ride up and down the bottom of the hook shaft.
3. "3" is the capture bar. In the two ends of the capture bar are holes that are ⅜" in diameter. Its vertical travel is guided by the ends of the hanger bar. When pulled up the capture bar allows one inch vertical clearance.
4. "4" is the spring. It is ⅛" in diameter and one inch long. It provides the biasing force that pushes the capture bar down onto the hanger bar.
5. "5" is the hanger bar. It is 5/16" in diameter. It may be fabricated in a "U" shape with 90 degree bends on each end. At the ends the clear height is 2 and ⅛ inches.
6. "6" is the supporting structure with a multi-purpose hanger. It is ⅜" inch wide, 16" long and is ⅞" total height.

It has an arch with a vertical clearance of 1 and ½ inches from center to side.

7. "7" are two posts mounted between "5" and "6" and slidably mounted through holes in "3". In the embodiment shown posts 7 are integral to bar 5 but are labeled separately for purposes of discussion.

The hanger is made of three pieces of molded plastic, a metal spring, and cadmium plated steel rod that serves as the hanger and shaft with an integral screw. The three molded pieces are the "Finger Pull"; the "Capture Bar"; and the "Supporting Structure".

The 6 and ⅝ inch "Cadmium Plated Steel Rod" will be inserted through the "Supporting Structure" so that 3 and ¾ inches of the rod will serve as the hook portion of the hanger, ⅞ inch of the rod will serve as a screw to secure the hanger in the "Supporting Structure", and the remainder will support the spring and go into the ⅛ inch shaft in the "Finger Pull" allowing its upward and downward movement.

The "Hanger Bar" will be molded as one piece of the three molded pieces and so designed so it may be inserted into the "Supporting Structure" after being inserted through the openings on each end of the "Finger Pull/Capture Bar". It will be held in a permanent position by a thermal weld.

The spring-loaded capture hanger is designed to make secure fastening of clothing quick and easy. The user picks up the hanger with the intention of placing one finger on each side of the "Finger Pull". While bracing the hand on top of the "Supporting Structure" with one finger on each side of the "Finger Pull", squeeze the "Finger Pull" toward the "Supporting Structure" thus raising the attach ed "Capture Bar" away from the "Hanger Bar" making it possible to insert an item of clothing between the "Capture Bar" and the "Hanger Bar". After the item of clothing is placed between the raised "Capture Bar" and the "Hanger Bar", the user releases the "Capture Bar" in order to secure the item of clothing. Repeat this same procedure in order to remove the item of clothing.

SPECIFIC EMBODIMENTS

Figure 2:
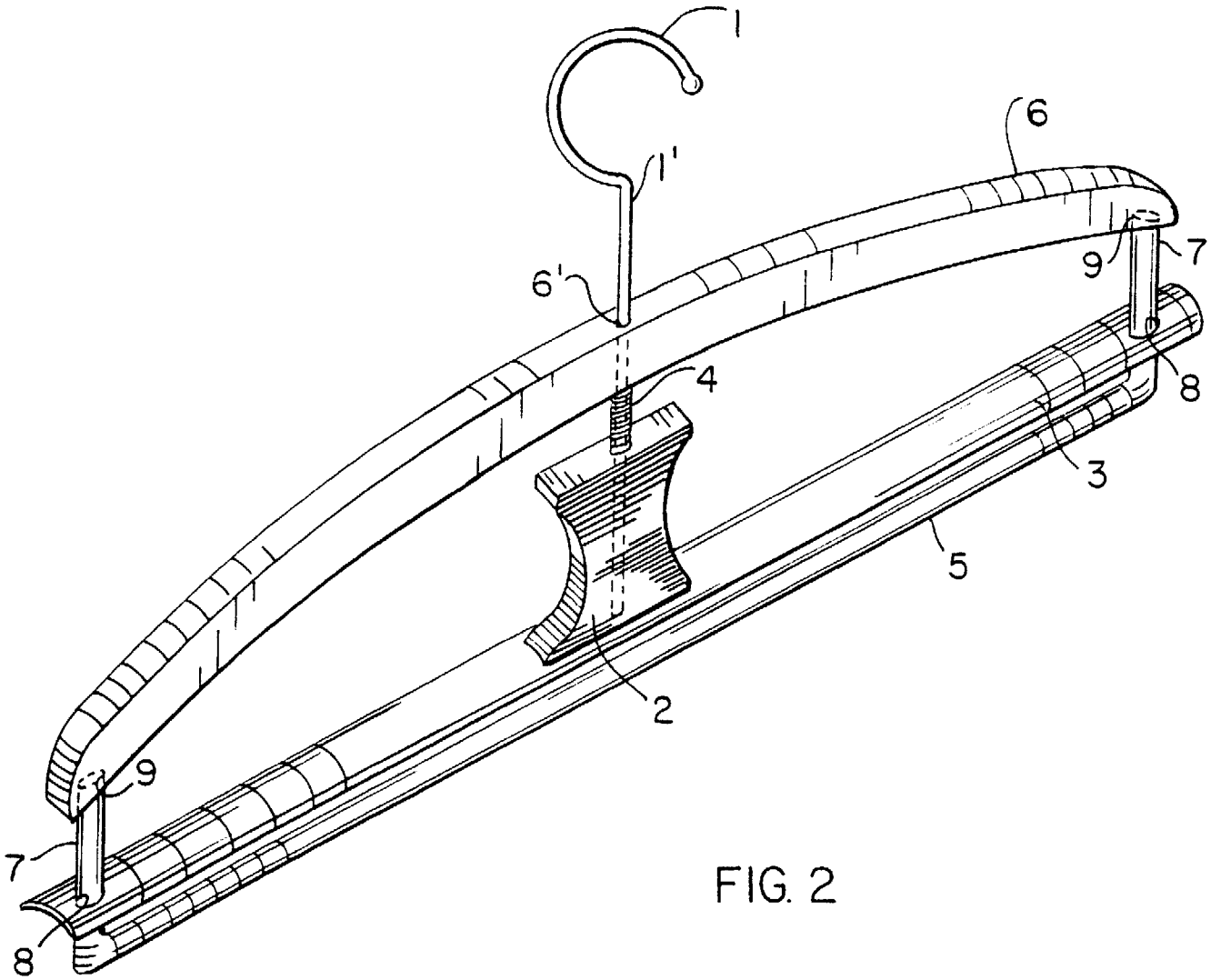
FIG. 2 is a pictorial embodiment of the hanger of FIG. 1 according to the present invention.

With regard now to FIG. 2, one embodiment of the hanger according to the invention is illustrated showing the curved shape of capture bar 3 and the circular shape of hanger bar 5. This particular embodiment is preferably used with men's ties and similar clothing.

In this embodiment posts 7 are integral to hanger bar 5 and may be force-fitted and/or glued into support structure 6 via holes 9. Capture bar 3 has two holes 8 through which the bar 3 is slidably mounted to the posts 7. This mounting arrangement helps to keep capture bar 3 horizontal. Finger pull 2 is permanently affixed to bar 3 and biased downwardly via spring 4 mounted around the extension of the shaft 1' of hook 1. The lower end of the shaft passes through passageway 6' and is permanently mounted to finger pull 2.

Alterations of the embodiments may be desirable. For example the embodiment of FIGS. 1 and 2 may be modified, if concerned only with a tie rack, so that the end of vertical shaft 1 (is screwed) into hanger bar 5. Thus the finger pull 2 and capture bar 3 may be moved upwardly and downwardly on shaft 1' against spring 4 without movement of hook 1 and hole 6' may become a mounting hole for the hook 1 if it terminated inwardly of support structure 6. Another separate shaft would then be needed for maintaining the spring 4 in position and guiding the movement of the finger pull 2 and capture bar 3.

Figure 3:
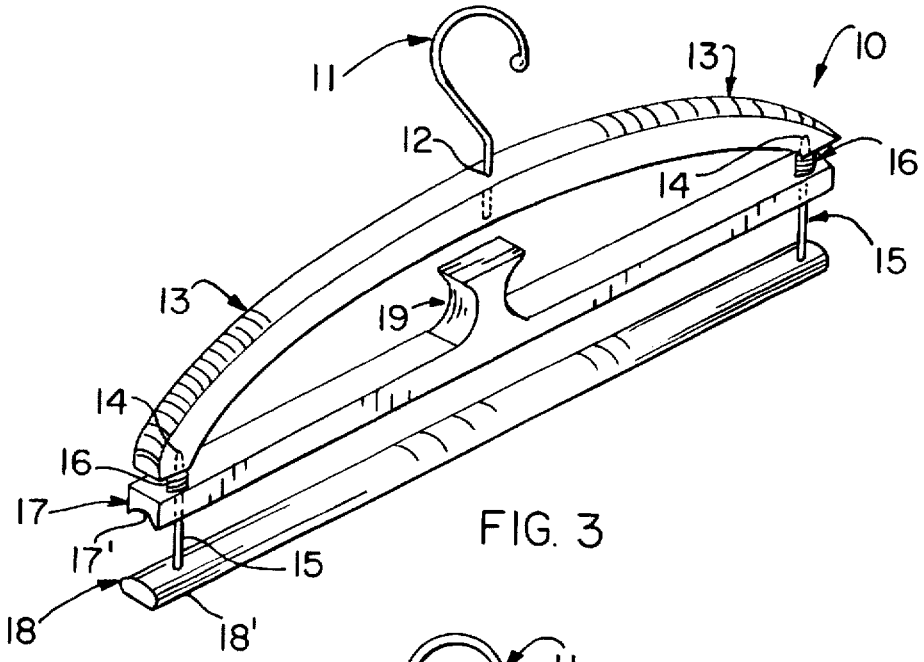
FIG. 3 is a pictorial view of a second embodiment of the present invention.
Figure 4:
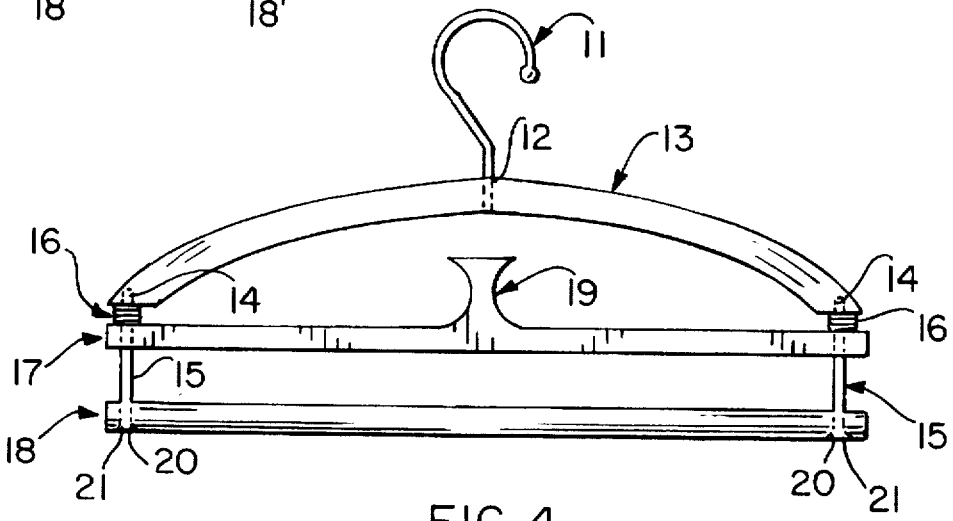
FIG. 4 is a side elevational view of the hanger of FIG. 3.
Figure 5:
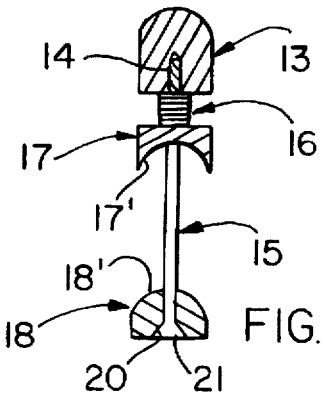
FIG. 5 is a pictorial cross sectional view of the components of the hanger of FIGS. 3–4.

A second embodiment of the present invention is illustrated in FIGS. 3–5. Hook member 11 is used to removably attach the hanger 10 to a cross bar or other member. The hook member 11 includes a lower shaft 12 that is permanently affixed into upper support member 13.

Holes 14 are used to mount the vertical posts 15 which have biasing springs 16 mounted therearound. Capture bar 17 has curved lower surface 17'. Hanger bar 18 has upper curved surface 18' to engage surface 17' and provide for a secure grasp of clothing thereinbetween.

Finger grip 19 is as before. The posts 15 are mounted in holes 20 in bar 18 and are sealed via means 21 which may be glue or a large head machined into posts 18. Posts 15 are preferably wooden dowel pins or other suitable material as desired.

Figure 6:
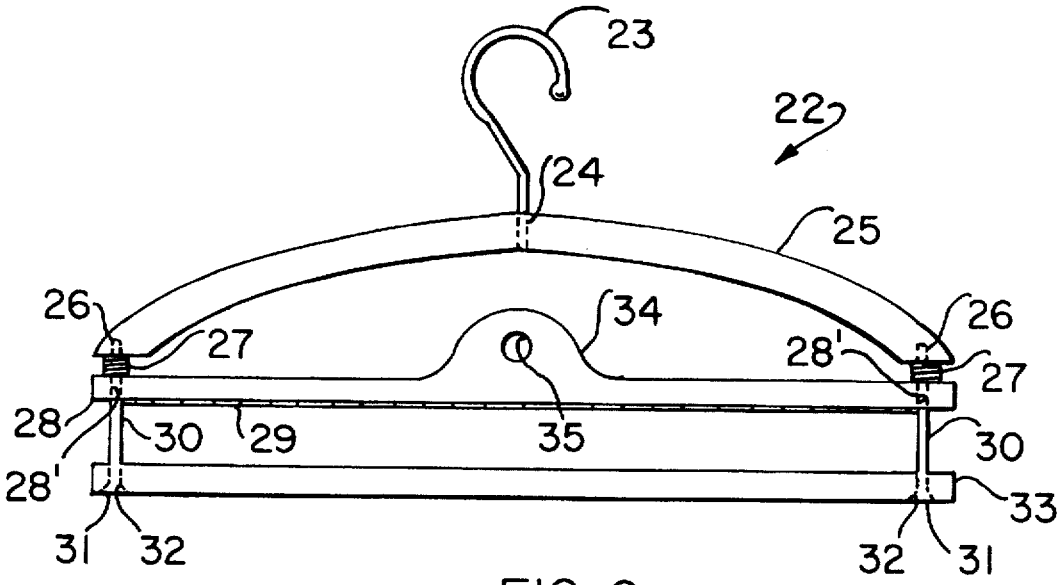
FIG. 6 is a pictorial view of a third embodiment of the present invention.

FIG. 6 illustrates a third embodiment of the present invention. The hanger 22 includes attachment means in the form of a hook member 23 with shaft 24 embedded in upper support member 25. Posts 30 are fitted into holes 26 and pass through capture bar 28 via holes 28' with downward bias provided by springs 27 that fit around the posts 30. Felt material 29 is glued to the lower surface of bar 28. In this embodiment the lower surface of bar 28 and the upper surface of hanger bar 33 are substantially planar rather than curved as in the previous two embodiments. Holes 31 and post sealing means 32 are as before as appropriate in the circumstances as determined by the weight the bar 33 is expected to carry. Flange 34 includes a finger hole 35 in this embodiment instead of the finger pull of the prior embodiments.

Figure 7:
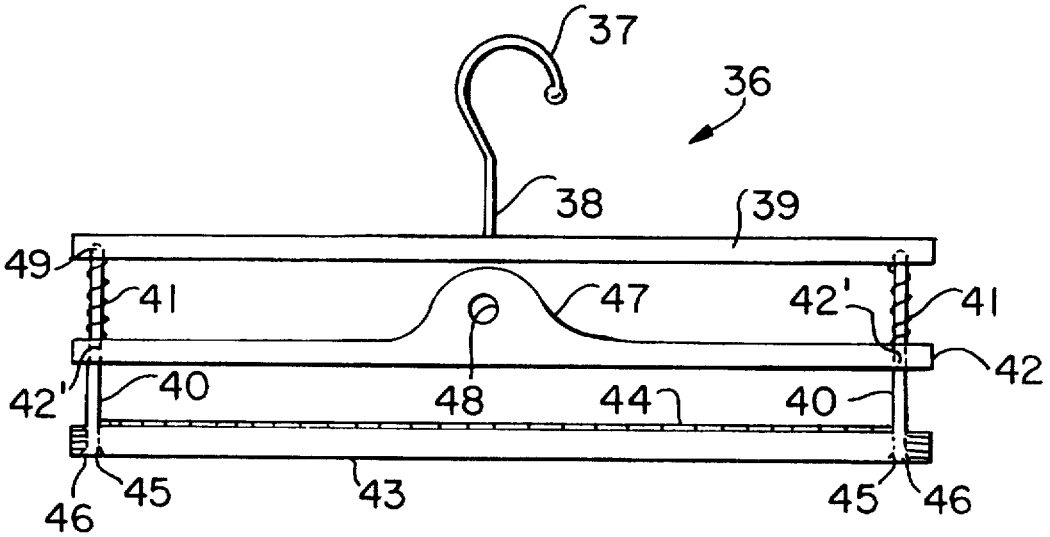
FIG. 7 is a pictorial view of a fourth embodiment of the hanger according to the present invention.

FIG. 7 is an illustration of the fourth and preferred embodiment of the hanger according to the present invention. The hanger 36 includes attachment means in the form of a hook member 37 with shaft 38 embedded in a substantially straight upper support member 39. Two vertical posts 40 are surrounded by biasing springs 41. The posts 40 fit through holes 42' in capture bar 42 and are attached to planar hanger bar 43 via holes 46 and securing means 46. Felt 44 is placed on the upper surface of bar 43 in the preferred embodiment in order to provide a frictional surface to prevent ties and other items from sliding off. Flange 47 supports finger hole 48.

The use of a straight rather than curved upper support member 39 in this embodiment provides for a more compact hanger assembly.

It is to be understood that the materials and precise dimensions of the components of each embodiment of the present invention may vary with the intended use as well as concerns of fashion and color coordination. The third and fourth embodiments of the present invention are constructed largely of dark stained wood for purposes of appearance only. In all the embodiments the engaging and hanger members will have slightly rounded edges where they come into contact with clothing articles to minimize damage thereto.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A garment hanger comprising a supporting structure with two arms extending in opposite directions and a central hole therethrough, a hanger bar with vertical ends connected to the bottom of the arms of the supporting structure with a horizontal bar between said vertical ends, a U-shaped capture bar having ends with holes receiving the vertical ends therethrough, and a hook extending through the central hole, the hook being connected to a finger pull which is attached to the capture bar, wherein said capture bar is biased by spring means to grasp a garment placed above the hanger bar.

2. A clothes hanger comprising an elongate support member having opposite end portions and an elongate hanger member having opposite end portions, a pair of spaced post members, each said post member being mounted between one said end portion of said support member and one said end portion of said hanger member to space said support and hanger members apart, an elongate engaging member having opposite end portions, each said end portion of said engaging member having a passageway therethrough, said engaging member being slidably mounted on said posts disposed in respective said passageways between said support and hanger members, biasing means attached between said support member and said engaging member for forcing said engaging member into contact with said hanger member to grasp articles of clothing placed therebetween, said engaging member including lifting means for moving said engaging member against said biasing means to provide space between said engaging and hanger members to permit ready removal of articles of clothing therefrom and attachment means mounted to one of said members for suspending said hanger vertically.

3. The clothes hanger as defined in claim 2 wherein said biasing means includes a coil spring around each said post.

4. The clothes hanger as defined in claim 2 wherein said engaging member includes a curved lower surface and said hanger member including a curved upper surface, said surfaces cooperating to engage articles therebetween when said engaging member is forced into contact with said hanger member by said biasing means.

5. The clothes hanger as defined in claim 2 wherein said support member includes a shaft passageway therethrough, said attachment means including a shaft member mounted through said shaft passageway and to said engaging means, said biasing means including a coil spring around said shaft.

6. The clothes hanger as defined in claim 2 wherein the lower surface of said engaging member is substantially planar, said upper surface of said hanger member is substantially planar, felt material attached to said surface.

7. The clothes hanger as defined in claim 2 wherein the upper surface of said hanger member and the lower surface of said engaging member are substantially planar, said upper surface being covered with felt material.

8. The clothes hanger as defined in claim 2 wherein said support member is substantially straight from one said end portion to the other said end portion.

9. The clothes hanger as defined in claim 2 wherein said attachment means has a lower portion attached to said support member and an upper portion, said upper portion including a hook member.

10. The clothes hanger as defined in claim 1 wherein said engaging member and said hanger member include elongated facing surfaces, an elongated felt material attached to at least one of said facing surfaces.

11. The clothes hanger as defined in claim 10 wherein said felt material is located on said engaging member.

12. The clothes hanger as defined in claim 10 wherein said felt material is located on said hanger member.

13. The clothes hanger as defined in claim 2 wherein said lifting means includes a horizontally disposed opening in said engaging member adapted to receive a finger of a user for lifting of said engaging member.

14. The clothes hanger as defined in claim 3 wherein said engaging member and said hanger member include elongated facing surfaces, an elongated felt material attached to at least one of said facing surfaces.

15. The clothes hanger as defined in claim 14 wherein said felt material is located on said hanger member.

16. The clothes hanger as defined in claim 15 wherein said attachment means has a lower portion attached to said support member and an upper portion, said upper portion including a hook member.

17. A clothes hanger comprising an elongate support member having opposite end portions and being substantially straight between said end portions, an elongate hanger member having opposite end portions and an upper surface, a pad of resilient material mounted along and to said upper surface, a pair of spaced post members, each said post member being permanently mounted between one said end portion of said support member and one said end portion of said hanger member, an elongate engaging member having opposite end portions and a lower surface, each said end portion of said engaging member having an opening therein, said engaging member being slidably mounted on said posts disposed in respective said openings between said support and hanger members, biasing means attached between said support member and said engaging member for forcing said engaging member into contact with said pad on said hanger member to grasp articles of clothing placed therebetween, said engaging member including lifting means for moving said engaging member against said biasing means to provide space between said engaging and hanger members to permit ready removal of articles of clothing therefrom, and attachment means mounted to one of said support members for suspending said hanger vertically.

18. The clothes hanger as defined in claim 10 wherein said biasing means includes a coil spring around each said post.

19. The clothes hanger as defined in claim 10 wherein said attachment means has a lower portion attached to a said support member and an upper portion, said upper portion including a hook member.

20. The clothes hanger as defined in claim 10 wherein said lifting means includes a horizontally disposed opening in said engaging member adapted to receive a finger of a user for lifting of said engaging member.

* * * * *